US006288713B1

(12) United States Patent
Lee et al.

(10) Patent No.: US 6,288,713 B1
(45) Date of Patent: Sep. 11, 2001

(54) AUTO MODE DETECTION CIRCUIT IN LIQUID CRYSTAL DISPLAY

(75) Inventors: Yong Ho Lee, Kwangju-gun; Soon Jea Lee, Ich'on, both of (KR)

(73) Assignee: Hyundai Electronics Industries Co., Ltd., Kyoungki-do (KR)

( * ) Notice: Subject to any disclaimer, the term of this patent is extended or adjusted under 35 U.S.C. 154(b) by 0 days.

(21) Appl. No.: 09/209,718

(22) Filed: Dec. 11, 1998

(30) Foreign Application Priority Data

Dec. 29, 1997 (KR) ..... 97-76727
Dec. 29, 1997 (KR) ..... 97-76751

(51) Int. Cl.[7] ..... G09G 5/00
(52) U.S. Cl. ..... 345/204
(58) Field of Search ..... 345/204, 87, 88, 345/127, 131, 132, 89

(56) References Cited

U.S. PATENT DOCUMENTS 4,316,276 2/1982 Koehler et al. ..... 368/70
4,685,769 8/1987 Fukuma et al. ..... 350/332
5,010,498 4/1991 Miyata ..... 364/519
5,390,293 2/1995 Nishioka et al. ..... 395/131
6,078,317 * 6/2000 Sawada ..... 345/204

FOREIGN PATENT DOCUMENTS 08248395 9/1996 (JP) ..... G02F/1/133
10126364 5/1998 (JP) ..... H04J/1/05

* cited by examiner

*Primary Examiner*—Richard Hjerpe
*Assistant Examiner*—Ronald Laneau
(74) *Attorney, Agent, or Firm*—Ladas & Parry

(57) ABSTRACT

An auto mode detection circuit in LCDS which detects a vertical synchronous signal provided to a liquid crystal display module (LCM) and selects the operation mode of LCDs with the detection result, comprising: clock signal generation for receiving a main clock signal to generate a clock signal; vertical synchronous signal detection means for detecting the vertical synchronous signal to generate a detection signal whenever a desired number of the clock signals are provided from the clock signal generation means; selection signal generation means for receiving the detection signal from the vertical synchronous signal detection means to generate a mode selection signal; and mode selection means for receiving the mode selection signal from the selection signal generation means to select one of a first signal for the first mode and a second signal for the second mode.

5 Claims, 8 Drawing Sheets

AUTO MODE DETECTION CIRCUIT IN LIQUID CRYSTAL DISPLAY

BACKGROUND OF THE INVENTION

This invention relates to liquid crystal displays (LCDs), and more particularly to an auto mode detection circuit in LCDs which detects a vertical synchronous signal provided to a liquid crystal display module (LCM) and selects the operation mode of LCDs with the detection result.

Recently, any one of a data enable signal DE not containing synchronous signal or a data enable signal DE+SYNC containing synchronous signal is provided to a LCM according to computer manufacturers. In the prior, it has been to difficult to manually select the operation mode of a LCM using an external jumper according to the mode of the input signal which is received from a personal computer. Besides, although it manually changes the mode by using an external jumper, because there is a case that a controller of a LCM does not operate, the driving circuit of a LCM should be changed. Therefore, if it corresponds to PC manufacturers which provides the different signals to a LCM, it should supplement the function for selecting the desired mode in a controller according to the input signal.

SUMMARY OF THE INVENTION

An object of the present invention is to provide an auto mode detection circuit in liquid crystal display devices which detects whether a vertical synchronous signal is received or not and selects any one of a DE only mode or a DE/SYNC mode according to the detection result.

According to an aspect of the present invention, there is provided to an auto mode detection circuit in liquid crystal display devices which selects one of a first mode of a DE only mode and a second mode of a DE/SYNC mode with detection of a vertical synchronous signal, comprising: clock signal generation means for receiving a main clock signal to generate a clock signal for detecting the vertical synchronous signal; vertical synchronous signal detection means for detecting the vertical synchronous signal to generate a detection signal whenever a desired number of the clock signals are provided from the clock signal generation means; selection signal generation means for receiving the detection signal from the vertical synchronous signal detection means to generate a mode selection signal; and mode selection means for receiving the mode selection signal from the selection signal generation means to select one of a signal for the first mode and a signal for the second mode.

In an embodiment of the present invention, the clock signal generation means includes a first 4-bit binary counter which is cleared by a reset signal and counts the main clock signal, thereby providing the most significant bit output of 4-bit outputs as its output signal; and a second 4-bit binary counter which is cleared by the reset signal and counts the output signal of the first counter, thereby providing the lowest significant bit output of 4-bit outputs as the clock signal to the vertical synchronous signal detection means. The vertical synchronous signal generation means includes: a first inverter for inverting the vertical synchronous signal externally received; a third 4-bit binary counter which is cleared by the reset signal, is loaded by the vertical synchronous signal inverted through the first inverter and counts the clock signal front the clock signal generation means, thereby providing a ripple carry out as its output signal whenever a selected number of the clock signals are applied to the vertical synchronous signal generation means; and a second inverter for inverting the output signal of the third counter to generate the detection signal to the mode selection signal generation portion.

In an embodiment of the present invention, the selection signal generation means includes: a D flip flop which the detection signal is applied as its clock signal, the reset signal is applied as its clear signal and a high state signal of Vcc is applied as its input signal; and a third inverter for inverting an output signal of the D flip flop to generate the mode selection signal to the mode selection means. The mode selection means includes: a first and a second multiplexers for selecting any one of the signal for the first mode and the signal for the second mode in accordance with the mode selection signal from the mode selection signal generation means.

According to another aspect of the present invention, there is provided to an auto mode detection circuit in liquid crystal display devices which selects one of a first mode of a DE only mode and a second mode of a DE/VSYNC mode with detection of a vertical synchronous signal, comprising:

clock signal generation means for receiving a main clock signal and a signal having a desired period to generate a clock signal for detecting the vertical synchronous signal; vertical synchronous signal detection means for detecting the vertical synchronous signal to generate a detection signal whenever a desired number of the clock signals are provided from the clock signal generation means; selection signal generation means for receiving the detection signal from the vertical synchronous signal detection means to generate a mode selection signal; and mode selection means for receiving the mode selection signal from the selection signal generation means to select one of a signal for the first mode and a signal for the second mode.

In another embodiment of the present invention, the clock signal generation means includes a first flip flop which a reset signal is applied as its clear signal, the main clock signal is applied as its clock signal and the signal having a desired period is provided as its input signal, thereby providing its input signal to the vertical synchronous signal detection means as the clock signal for detecting the vertical synchronous signal. The vertical synchronous signal detection means includes: a first inventer for inverting the vertical synchronous signal; and a counter which is cleared by a reset signal and is loaded by the vertical synchronous signal inverted through the first inverter to count the clock signal from the clock signal generation means and generates the detection signal indicating whether the vertical synchronous signal is received to the mode selection signal generation means, whenever a selected number of the clock signals are applied from the clock signal generation means.

In another embodiment of the present invention, the mode selection signal generation means includes: a second flip flop which a reset signal is applied as its clear signal, the main clock signal is applied as its clock signal and the detection signal of the vertical synchronous signal detection means is applied as its input signal, thereby providing the detection signal of the vertical synchronous signal detection means as its output signal at a rising edge of the main clock signal; a second inverter for inverting the output signal of the second flip flop; a third flip flop which a reset signal is applied as its clear signal, an output signal of the second inverter is applied as its clock signal and a high state signal of Vcc is applied as its input signal; a third inverter for inverting an output signal of the third flip flop to generate the mode selection signal to the mode selection means. The mode selection means includes: a first multiplexer and a second multiplexer for selecting one of the signal for the first mode and the signal for the second mode in accordance with the mode selection signal from the mode selection signal generation means.

DETAILED DESCRIPTION OF THE INVENTION

Figure 1:
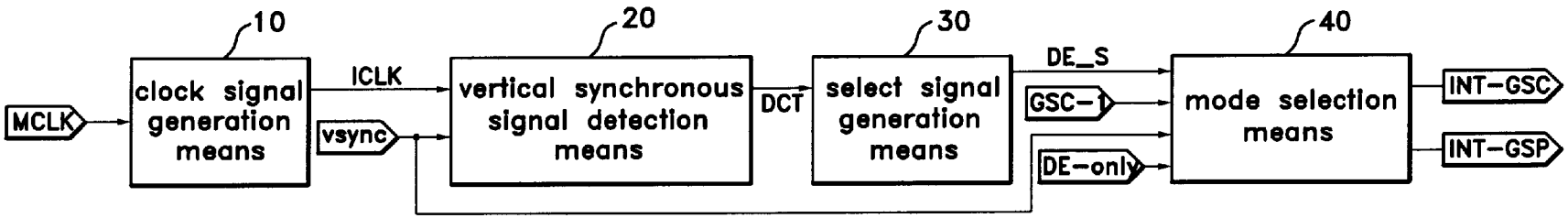
FIG. 1 is a block diagram of an auto mode detection circuit of a liquid crystal display in accordance with an embodiment of the present invention.
Figure 2:
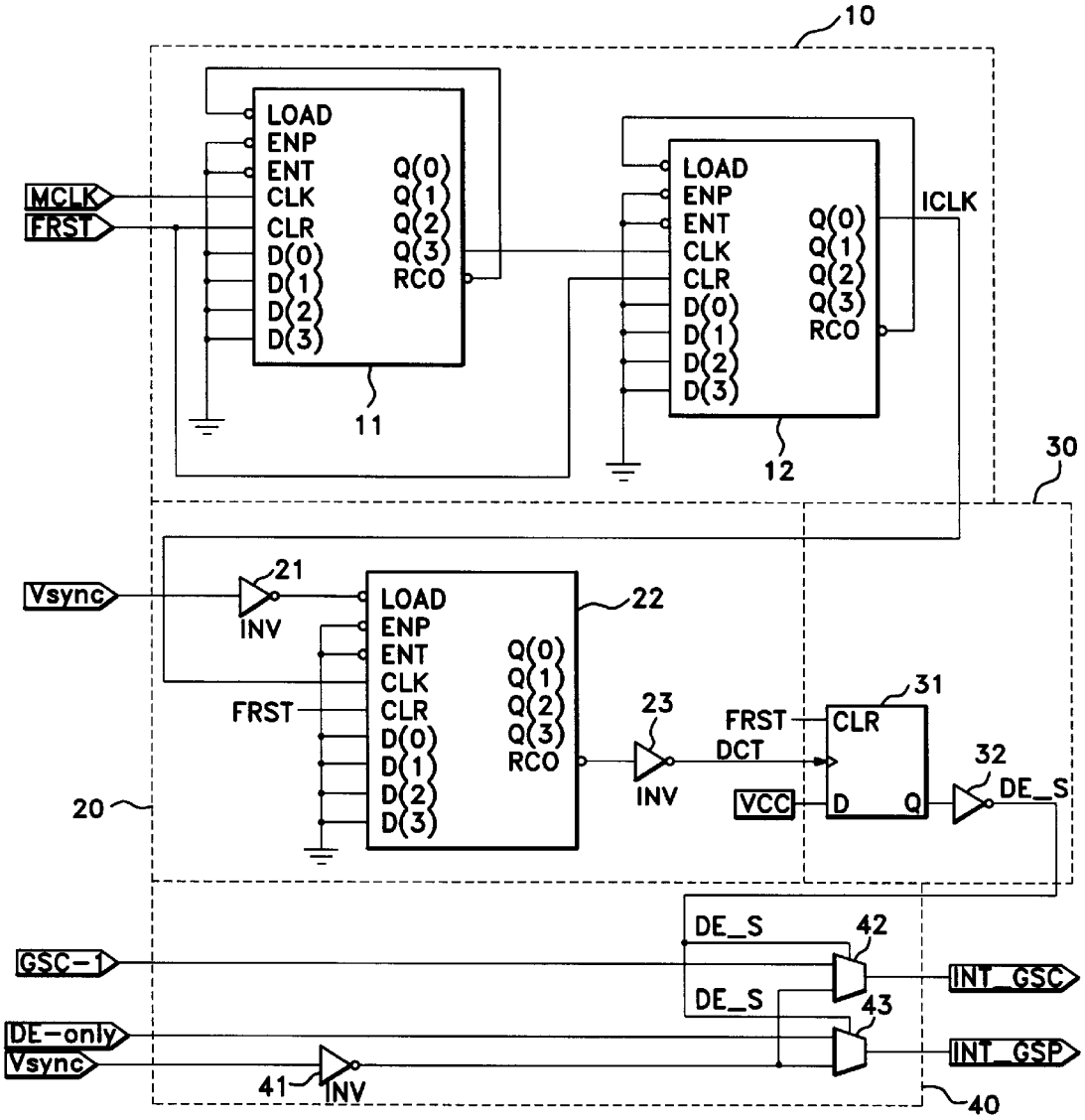
FIG. 2 is a detailed diagram of the auto mode detection circuit of a liquid crystal display in FIG. 1.

FIG. 1 is a block diagram of an auto mode detection circuit of a liquid crystal display in accordance with an embodiment of the present invention and FIG. 2 is a detailed diagram of the auto mode detection circuit in FIG. 1. Referring to FIG. 1 and FIG. 2, the auto mode detection circuit includes a clock signal generation portion 10 which receives a main clock signal MCLK which is externally provided to generate a clock signal ICLK. The clock signal generation portion 10 is cleared by a reset signal FRST which is externally provided and then counts the main clock signal MCLK to generate the clock signal ICLK for detecting whether the vertical synchronous signal VSYNC is received or not. The clock signal generation portion 10 includes a first 4-bit binary counter 11 which is cleared by the reset signal FRST and counts the main clock signal MCLK, thereby providing the most significant bit output Q3 of 4-bit outputs Q0–Q3 as its output signal and a second 4-bit binary counter 12 which is cleared by the reset signal FRST and counts the output signal of the first counter 11, thereby providing the lowest significant bit output Q0 of 4-bit outputs Q0–Q3 as the clock signal ICLK.

The auto mode detection circuit of the present invention includes a vertical synchronous signal generation portion 20 which receives the clock signal ICLK from the clock signal generation portion 10 and detects whether a vertical synchronous signal VSYNC is received or not, to generate a detection signal DCT. The vertical synchronous signal detection means 20 includes an inverter 21 for inverting the vertical synchronous signal VSYNC; a third 4-bit binary counter 22 which is cleared by the reset signal FRST and is loaded by the vertical synchronous signal inverted through the first inverter 21 to count the clock signal ICLK from the clock signal generation portion 10, thereby providing a ripple carry out RCO as its output signal whenever a selected number of the clock signals ICLK from the clock signal generation portion 10 are applied to the vertical synchronous signal generation portion 20; and a second inverter for inverting the output signal RCO of the third counter 22 to generate the detection signal DCT.

The auto mode detection circuit includes a selection signal generation portion 30 which generates a mode selection signal DE_S for selecting any one of a DE only mode and a DE/SYNC mode, in accordance with the detection 10 signal DCT from the vertical synchronous signal detection portion 20. The selection signal generation portion 30 includes a D flip flop 31 which the detection signal DCT is applied as its clock signal, the reset signal FRST is applied as its clear signal and a high state signal of Vcc is applied as its input signal and a third inverter 32 for inverting an output signal of the D flip flop 31 to generate the mode selection signal DE_S.

The auto mode selection circuit includes a mode selection portion 40 which selects any one of the DE only mode and the DE/SYNC mode in accordance with the mode selection signal DE_S generated from the mode selection signal generation portion 30. The mode selection portion 40 includes a fourth inverter 41 for inverting the vertical synchronous signal VSYNC and a first and a second multiplexers 42 and 43 for selecting any one of the. DE only mode and a DE/VSYNC mode in accordance with the mode selection signal DE_S from the mode selection signal generation portion 30. The mode selection portion 40 selects a GSC_I signal and the vertical synchronous signal inverted through the fourth inverter 41 which are signals for the DE/SYNC mode and provides them to an internal signal generator of a liquid crystal display module (not shown in drawings), when the vertical synchronous signal detection portion 20 detects the vertical synchronous signal VSYNC and then the mode selection signal generation portion 30 generates the mode selection signal DE_S of a low state, that is, when the DE/SYNC mode is selected. On the other hand, the mode selection portion 40 selects a signal for the DE only mode and provides it to an internal signal generator of a liquid crystal display module (not shown in drawings), when the vertical synchronous signal VSYNC is not detected through the vertical synchronous signal detection portion 20 and then the mode selection signal DE_S of a high state is generated from the mode selection signal generation portion 30, that is, when the DE only mode is selected.

Figure 5A:
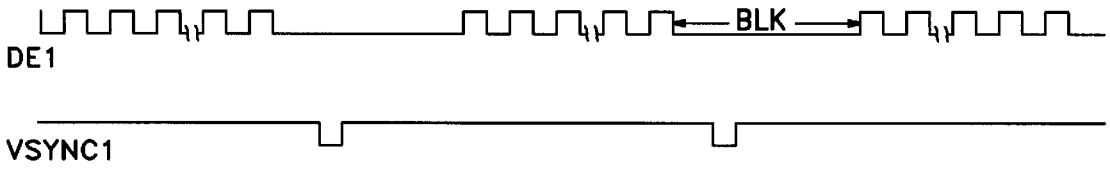
FIG. 5*a* and FIG. 5*b* are diagrams illustrating the DE/SYNC mode and a DE only mode, respectively.
Figure 5B:
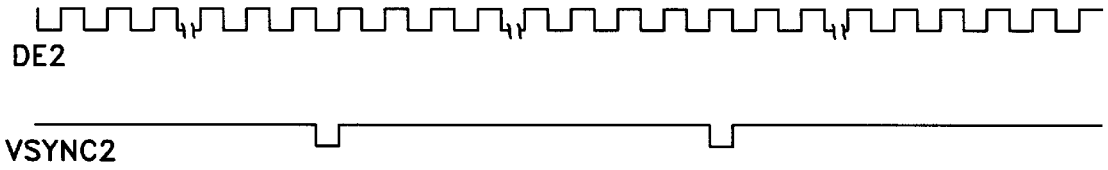

The operation of the auto mode detection circuit of a LCD in accordance with an embodiment of the present invention will be described in more detail with reference to the accompanying drawings. First of all, the DE only mode and the DE/SYNC mode will be described with reference to FIG. 5*a* and FIG. 5*b*. The DE only mode is an operation mode that a data enable signal DEI itself has a blank period BLK which is recognized as the vertical synchronous signal as shown in FIG. 5*a* and the separate vertical synchronous signal VSYNC1 is not required. Therefore, in the DE only mode, without a separate vertical synchronous signal VSYNC1, a LCM (not shown in drawings) can be driven by only the data enable signal DE1. On the other hand, the DE/SYNC mode is an operation mode that a data enable signal DE2 itself does not have a blank period BLK which is recognized as the vertical synchronous signal as shown in FIG. 5*b* and the separate vertical synchronous signal VSYNC2 should be required.

The auto mode detection circuit detects whether the vertical synchronous signal is externally received or not and selects the DE/SYNC mode in case the vertical synchronous signal is received, or the DE only mode in case the vertical synchronous signal is not received. The mode selection operation of the DE only mode or selects the DE/SYNC mode with the detection of the vertical synchronous signal will be described with reference to FIG. 3 and FIG. 4.

Of the clock signal generation portion 10, the counter 11 is cleared by the initial reset signal FRST and then counts the main clock signal MCLX which is applied as its clock signal.

In the preferred embodiment, if the main clock signal MCLK is 40 MHz, the period of the main clock signal is 25 μs. The most significant bit (MSB) output Q3 of 4-bit outputs Q0–Q3 of the counter 11 is provided to the clock signal of the counter 12. The counter 12 counts the output signal Q3 from the first counter 11 to generate the lowest significant bit(LSB) output Q0 of 4-bit outputs Q0–Q3 to the vertical synchronous signal detection portion 20 as the clock signal ICLK for detecting the vertical synchronous signal VSYNC. At this time, the clock signal ICLK generated from the clock signal generation portion 10 has a period of 800 ns.

Figure 4A:
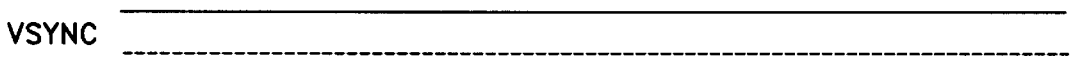
FIG. 4*a* through FIG. 4*d* are timing diagrams of the auto mode detection circuit in a DE only mode where a vertical synchronous signal is contained in a data enable signal.
Figure 4B:
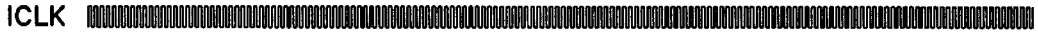

The clock signal ICLK generated from the clock signal generation portion 10 is provided to the counter 22 of the vertical synchronous signal detection portion 20 as its clock signal. The counter 22 is loaded by the inverted vertical synchronous signal from the inverter 21 to count the clock signal ICLK from the clock signal generation portion 10. As shown in FIG. 4*a*, when the vertical synchronous signal VSYNC is not externally received to the auto mode detection circuit, the vertical synchronous signal VSYNC continuously remains at a high state. Therefore, a low state output signal of the inverter 21 is applied to a load terminal LOAD of the counter 22 and then the counter 22 does not count the clock signal ICLK which is received from the clock signal generation portion 10 as its clock signal as shown in FIG. 4*b*.

Figure 4C:
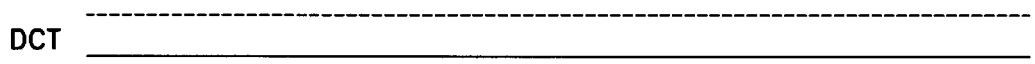
Figure 4D:
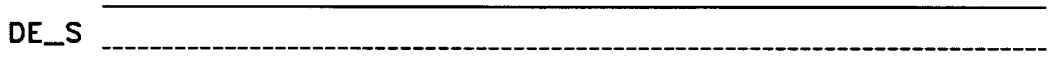

Accordingly, the vertical synchronous signal detection portion 20 generates the detection signal DCT of a low state shown in FIG. 4*c* to the selection signal generation portion through the inverter 23. The D flip flop 31 of the mode selection signal generation portion 30 is not triggered and the inverter 32 generates the mode selection signal DE_S of a high state shown in FIG. 4*d* to the mode selection portion 40. The DE only mode is selected and then the mode selection portion 40 selects the signal for the DE only mode through the multiplexers 42 and 43 in accordance with the mode selection signal DE_S so that the signal for the DE only mode is provided to an internal signal generator of the LCM.

Figure 3A:
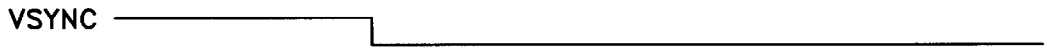
FIG. 3*a* through FIG. 3*d* are timing diagrams of the auto mode detection circuit in a DE/SYNC mode where a vertical synchronous signal is not contained in a data enable signal.
Figure 3B:
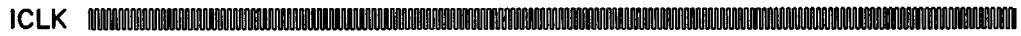
Figure 3C:
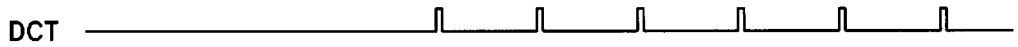
Figure 3D:
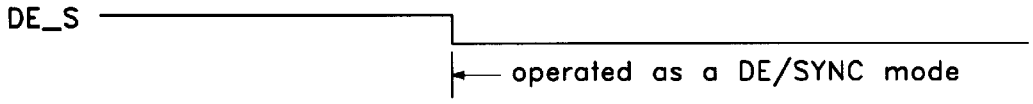

Next, in case the vertical synchronous signal is received to the auto mode detection circuit, the vertical synchronous signal VSYNC has a low state period as shown in FIG. 3*a* and the output signal of the inverter 21 is a high A state in the low state period of the vertical synchronous signal VSYNC to load the counter 22. The counter 22 counts the clock signal ICLK shown in FIG. 3*b* from the clock signal generation portion 10 to generate a pulse signal every a predetermined period and the output signal RCO of the counter 22 is inverted through the inverter 23 to provide it as the detection signal DCT shown in FIG. 3*c*. At this time, the counter 22 generates the pulse signal and the vertical signal detection portion 30 generates the detection signal DCT through the second inverter 23, when every 16 clock signals ICLK from the clock signal generation portion 10 are applied to the counter 22.

The detection signal DCT is provided to the D flip flop 31 in the mode selection signal generation portion 30 as its clock signal and the D flip flop is triggered to generate a high state output signal, when the detection signal firstly turns from a low state to a high state. Therefore, the inverter 32 generates the mode selection signal DE_S of a low state to the mode selection portion 40. The DE/SYNC mode is selected and then the mode selection portion 40 selects the signal for the DE/SYNC mode through the multiplexers 42 and 43 in accordance with the mode selection signal DE_S from the mode selection signal generation portion 30 so that the signals VSYNC and GSC_I are provided to an internal signal generator in a LCM. At this time, the signal GSC_I is a gate shift clock signal for driving a gate driver of a LCM which is generated from a controller of a LCM. In the auto mode detection circuit of the preferred embodiment, whenever the clock signal generation portion 10 generates 16 clock signals, the mode selection signal generation portion 30 generates the mode selection signal DE_S, thereby eliminating the noise effect.

Figure 6:
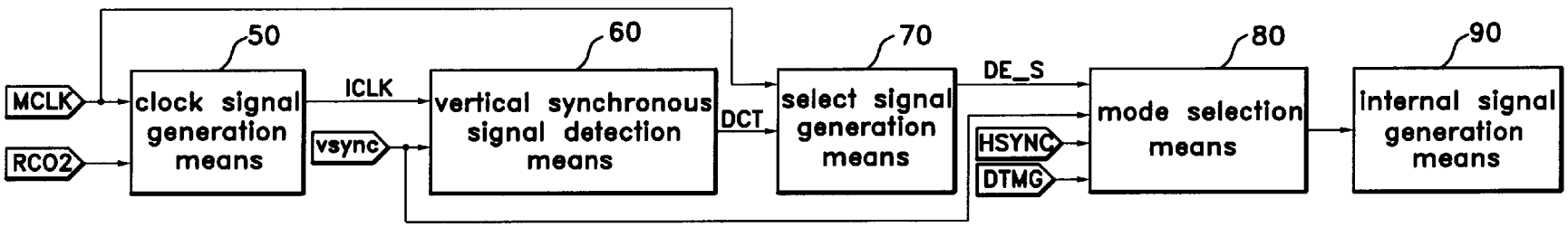
FIG. 6 is a block diagram of an auto mode detection circuit of a liquid crystal display in accordance with another embodiment of the present invention.
Figure 7:
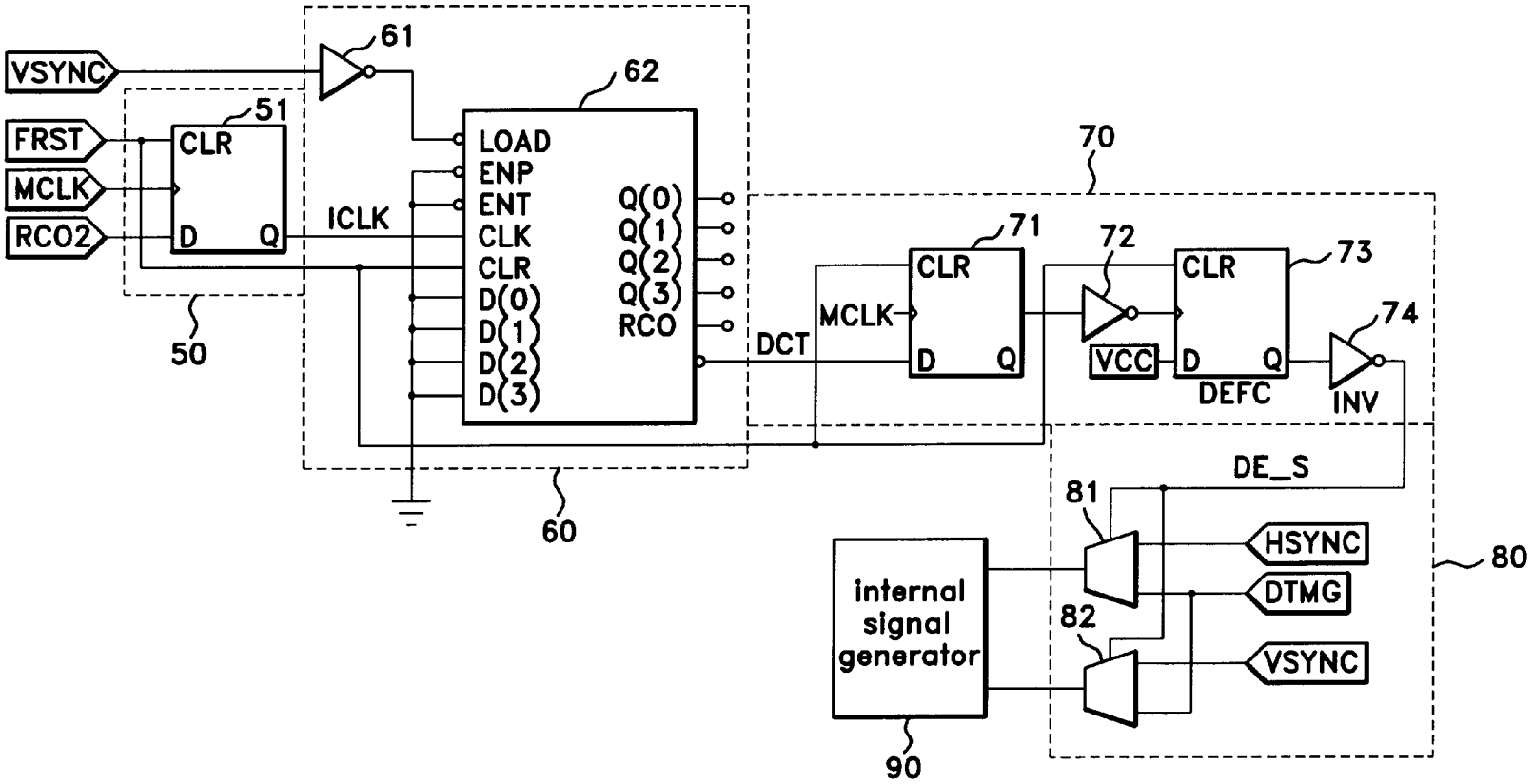
FIG. 7 is a detailed diagram of the auto mode detection circuit in FIG. 6.

FIG. 6 is a block diagram of an auto mode detection circuit of a liquid crystal display in accordance with another embodiment of the present invention and FIG. 7 is a detailed diagram of the auto mode detection circuit in FIG. 6. Referring to FIG. 6 and FIG. 7, the auto mode detection circuit includes a clock signal generation portion for generating a clock signal ICLK, a vertical synchronous signal detection portion 60 for detecting the vertical synchronous signal to generate a detection signal, a mode selection signal generation portion 70 for generating a mode selection signal and a mode selection portion 80 for selecting one of a DE only mode or a DE/SYNC mode. The clock signal generation portion 50 receives a main clock signal MCLK as a clock signal and an input signal RCO2 having a predetermined period which are externally provided and generates the clock signal ICLK. The clock signal generation portion 50 is cleared by a reset signal FRST which is externally provided and the signal RCO2 having a selected period is applied as its input signal to generate the clock signal ICLK for detecting whether the vertical synchronous signal VSYNC is received or not. The clock signal generation portion 50 includes a first D flip flop 51 which the reset signal FRST is applied as its clear signal, the main clock signal MCLK is applied as its clock signal and the signal having a desired period is applied as its input signal, thereby providing its output signal as the clock signal to the vertical synchronous signal detection portion 60.

The vertical synchronous signal generation portion 60 receives the clock signal ICLK from the clock signal generation portion 50 and detects whether the vertical a synchronous signal VSYNC is received or not, to generate the detection signal DCT. The vertical synchronous signal a detection means 60 includes a first inverter 61 for inverting the vertical synchronous signal VSYNC externally received; and a 4-bit binary counter 62 which is cleared by the reset signal FRST and is loaded by the vertical synchronous signal VSYNC inverted through the first inverter 61 to count the clock signal ICLK from the clock signal generation portion 50, thereby providing a ripple carry out RCO as the detection signal DCT, whenever a selected number of the clock signal ICLK for example, 16 clock signals are applied to the vertical synchronous signal generation portion 60.

The selection signal generation portion 70 which generates the mode selection signal DE_S for selecting any one of the DE only mode and the DE/VSYNC mode, in accordance with the detection signal DCT from the vertical synchronous signal detection portion 60. The selection signal generation portion 70 includes a second D flip flop 71 which the detection signal DCT is applied as its input signal, the reset signal FRST is applied as its clear signal and the main clock signal is applied as its clock signal, a second inverter 72 for inverting an output signal of the second D flip flop 71, a third D flip flop 73 which an output signal of the second inverter 72 is applied as its clock signal, the initial reset signal FRST is applied as its clear signal and a high state signal of VCC is applied as its input signal, and a third inverter 74 for inverting an output signal of the third D flip flop 73 to generate the mode selection signal DE_S to the mode selection portion 80.

The mode selection portion 80 selects any one of the DE only mode and the DE/VSYNC mode in accordance with the mode selection signal DE_S generated from the mode selection signal generation portion 70. The mode selection portion 80 includes a first multiplexer 81 and a second multiplexer 82 for selecting any one of the DE only mode and a DE/VSYNC mode in accordance with the mode selection signal DE_S from the mode selection signal generation portion 70. The mode selection portion 80 selects a first signal for the DE/SYNC mode which is a horizontal synchronous signal HSYNC externally received and the vertical synchronous signal VSYNC, to provide it to an internal signal generator 90 of a liquid crystal display module (not shown in drawings), when the vertical synchronous signal detection portion 60 detects the vertical synchronous signal VSYNC and then the mode selection signal generation portion 70 generates the mode selection signal DE_S of a low state. On the other hand, the mode selection portion 80 selects a second signal for the DE only mode which is a data enable signal externally received, to provide it to an internal signal generator 90 of a liquid crystal display module, when the vertical synchronous signal VSYNC is not detected through the vertical synchronous signal detection portion 60 and then the mode selection signal DE_S of a high state is generated from the mode selection signal generation portion 70.

The operation of the auto mode detection circuit of a LCD in accordance with another embodiment of the present invention will be described in more detail with reference to the accompanying drawings. As above mentioned in FIG. 5*a* and FIG. 5*b*, the DE only mode is an operation mode that a data enable signal DE1 itself has a blank period BLK which is recognized as the vertical synchronous signal and therefore, without a separate vertical synchronous signal VSYNC1, a LCM (not shown in drawings) can be driven by only the data enable signal DE1. On the other hand, the DE/SYNC mode is an operation mode that a data enable signal DE2 itself does not have a blank period BLK which is recognized as the vertical synchronous signal and the separate vertical synchronous signal VSYNC2 should be required.

Figure 8A:
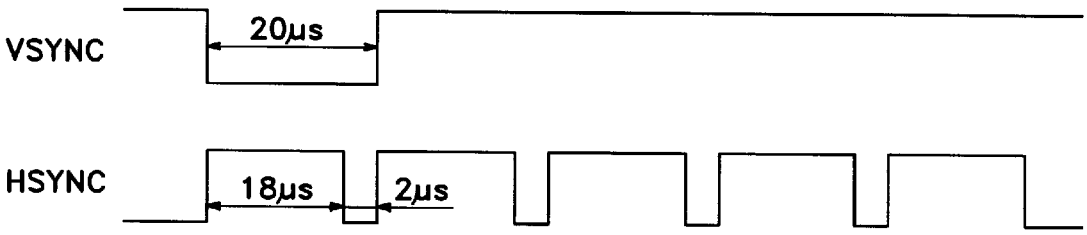
FIG. 8*a* and FIG. 8*b* are timing diagrams of the auto mode detection circuit in FIG. 6.
Figure 8B:
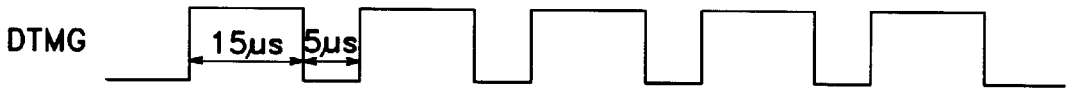

The auto mode detection circuit detects whether the vertical synchronous signal is externally received or not and then selects the DE/SYNC mode to provide the signal for the DE/SYNC mode as shown in FIG. 8*a* to the internal signal generator 90 of a LCM in case the vertical synchronous go signal is received, or the DE only mode to provide the signal for the DE only mode as shown in FIG. 8*b* to the internal signal generator 90 in case the vertical synchronous signal is not received. The mode selection operation of the DE only mode or the DE/SYNC mode with the detection of the vertical synchronous signal is as follows. The first D flip flop 51 in the clock signal generation portion 50 is cleared by the reset signal FRST and then provides the input signal RCO2 as the clock signal ICLK for detecting the vertical synchronous signal at a rising edge of the main clock signal MCLK. At this time, the input signal RCO2 has a period of 270 ns.

The output signal ICLK of the first flip flop 51 is applied to the 4-bit binary counter 62 of the vertical synchronous signal detection portion 60 as its clock signal. The counter 62 receives the vertical synchronous signal inverted through the first inverter 61 as a load signal and therefore, the counter 62 operates during the low state period of the vertical synchronous signal which is 20 $\mu$m. That is, the counter 62 is loaded by the vertical synchronous signal VSYNC received through the first inverter 61 to count the clock signal ICLK from the clock signal generation portion 50. The counter 62 generates the output signal that the clock signal ICLK is divided by 16 as the detection signal DCT. Therefore, the counter 62 generates the detection signal DCT whenever the clock signal generation portion 50 generates 16 clock signals. For example, if the period of the input signal RCO2 is 270 ns, the counter 62 divides the input signal RCO2 by 16 and then is the counter 62 generates the detection signal DCT every 17.7 $\mu$m which is 270 $\mu$s×16.

The detection signal DCT from the vertical synchronous signal generation portion 60 is applied to the D flip flop 71 as its input signal in the mode selection signal generation portion 70. The D flip flop 71 outputs the detection signal DCT received from the vertical synchronous signal detection portion 60 as its input signal at a rising edge of the main clock signal MCLK to the inverter 72. The inverter 72 inverts the output of the D flip flop 71 and the D flip flop 73 receives an output signal of the inverter 72 as its clock signal and generates its output signal to the inverter 74. The inverter 74 inverts the output signal of the flip flop 73 to generate the mode selection signal DE_S to the mode selection portion 80. The mode selection portion 80 receives the mode selection signal of a low state and selects the DE/SYNC mode.

In accordance with the mode selection signal DENS of a low state, the mode selection portion 80 selects the signal for DE/SYNC mode which is the vertical synchronous signal VSYNC and the horizontal synchronous signal HSYNC as shown in FIG. 8*a* through the multiplexers 81 and 82 and provides the selected signals to the internal signal generator 90 of a LCM. The internal signal generator 90 receives the vertical synchronous signal VSYNC and the horizontal synchronous signal HSYNC selected by the mode selection portion 80 to generate signals required in driving a LCM with the DE/SYNC mode.

On the other hand, the vertical synchronous signal does not have a low state, Therefore, the counter 62 is not loaded by the vertical synchronous signal inverted through the inverter 61 and the counter 62 does not carry out the counting operation of the clock signal ICLK from the clock signal generation portion 50. Therefore, the counter 62 generates the detection signal DCT of a high state and the D flip flop 71 receives the detection signal of a high state as its input signal to generate the output signal of a high state. The output signal of a high state from the D flip flop 71 is applied to the inverter 72 and then inverted. The D flip flop 73 generates a low state out signal to the inverter 74. The inverter 74 inverts the output signal of the D flip flop 73 to generate the mode selection signal of a high state to the mode selection portion 80. The mode selection portion 80 selects the DE only mode in accordance with the mode selection signal of a high state. The signal for the DE only mode is selected through the multiplexers 81 and 82 and then provided to the internal signal generator 80 of the LCM. The internal signal generator 90 receives the signal for the DE only mode form the mode selection portion 90 to generates signals required in driving a LCM with the DE only mode.

In another preferred embodiment, the vertical synchronous signal detection portion 20 divides the input signal RCO2 of the D flip flop 51 by 16 through the counter 62 to generate the detection signal DCT. Therefore, the vertical synchronous signal of below 17.7 $\mu$m caused by the noise is filtered through the vertical synchronous signal detection portion 60. The vertical synchronous signal detection portion 60 accurately detects the vertical synchronous signal without the noise effect and then the mode selection signal generation portion 70 generates the accurate mode detection signal DE_S.

According to the present invention, the auto mode detection circuit detects the vertical synchronous signal and can automatically select any one of DE only mode and the DE/SYNC mode with the detection result. Therefore, it can select the operation mode with ease without the change of the mode by using the manual jumper. Besides, it can correspond to different modes by using one controller.

The foregoing description shows only a preferred embodiment of the present invention. Various modifications are apparent to those skilled in the art without departing from the scope of the present invention which is only limited by the appended claims. Therefore, the embodiment shown and described is only illustrative, not restrictive.

What is claimed is:

1. An auto mode detection circuit in liquid crystal display devices which selects one of a first mode of DE only mode and a second mode of a DE/SYNC mode with detection of a vertical synchronous signal, comprising:

clock signal generation means for receiving a main clock signal and a signal having a selected period to generate a clock signal for detecting the vertical synchronous signal;

vertical synchronous signal detection means for detecting the vertical synchronous signal to generate a detection signal whenever a desired number of the clock signals are provided from the clock signal generation means;

selection signal generation means for receiving the detection signal from the vertical synchronous signal detection means to generate a mode selection signal;

mode selection means for selecting one of a first signal for the first mode and a second signal for the second mode in accordance with the mode selection signal from the selection signal generation means;

a first flip flop which a reset signal is applied as its clear signal, the main clock signal is applied as its clock signal, and the signal having a selected period is applied as its output, thereby providing the signal having a selected desired period as the clock signal to the vertical synchronous signal detection means at a rising edge of the main clock signal;

a first inverter for inverting the vertical synchronous signal;

a counter which is cleared by a reset signal and is loaded by the vertical synchronous signal inverted through the first inverter to count the clock signal from the clock signal generation means and generates the detection signal indicating whether the vertical synchronous signal is received to the mode selection signal generation means, whenever a selected number of the clock signals are applied from the clock signal generation means and a second flip flop which a reset signal is applied as its clear signal, the main clock signal is applied as its clock signal and the detection signal of the vertical synchronous signal detection means is applied as its input signal, thereby providing the detection signal of the vertical synchronous signal detection means as its output signal at a rising edge of the main clock signal;

a second inverter for inverting the output signal of the second flip flop; a third flip flop which a reset signal is applied as its clear terminal, an output signal of the second inverter is applied as its clock signal and a high state signal of Vcc is applied as an input signal;

a third inverter for inverting an output signal of the second third flip flop to generate the mode selection signal to the mode selection signal generation means.

2. The auto mode detection circuit as claimed in claim 1 wherein the mode selection means includes: a first multiplexer and a second multiplexer for selecting one of the first signal for the first mode and the second signal for the second mode in accordance with the mode selection signal from the mode selection signal generation means.

3. An auto mode detection circuit in liquid crystal display devices which selects one of a first mode of a DE only mode and a second mode of a DE/SYNC mode with detection of a vertical synchronous signal, comprising:

clock signal generation portion for receiving a main clock signal to generate a clock signal for detecting the vertical synchronous signal;

vertical synchronous signal detection means for detecting the vertical synchronous signal to generate a detection signal whenever a desired number of the clock signals are provided from the clock signal generation means;

selection signal generation means for receiving the detection signal from the vertical synchronous signal detection means to generate a mode selection signal; and mode selection means for receiving the mode selection signal from the selection signal generation means to select one of the first mode and the second mode;

a first 4-bit binary counter which is cleared by a reset signal and counts the main clock signal, thereby providing the most significant bit output of 4-bit outputs as its output signal;

a second 4-bit binary counter which is cleared by the reset signal and counts the output signal of the first counter, thereby providing the lowest significant bit output of 4-bit outputs as the clock signal to the vertical synchronous signal means;

a inverter for inverting the vertical synchronous signal externally received;

a third 4-bit binary counter which is cleared by the reset signal, is loaded by the vertical synchronous signal inverted through the first inverter and counts the clock signal form the clock signal generation means, thereby providing a ripple carry out as its output signal whenever a selected number of the clock signals are applied to the vertical synchronous signal generation means; and a second inverter for inverting the output signal of the third counter to generate the detection signal to the mode selection signal generation means.

4. The auto mode detection circuit as claimed in claim 3, wherein the selection signal generation means includes:

a D flip flop which the detection signal is applied as its clock signal, the reset signal is applied as its clear signal and a high state signal of Vcc is applied as its input signal; and a third inverter for inverting an output signal of the D flip flop to generate the mode selection signal to the mode selection means.

5. The auto mode selection circuit as claimed in claim 4, wherein the mode selection means includes: a first and a second multiplexers for selecting one of the first signal for the first mode and the second signal for the second mode in accordance with the mode selection signal from the mode selection signal generation means.

* * * * *